US008297048B2

(12) United States Patent
Biedler et al.

(10) Patent No.: US 8,297,048 B2
(45) Date of Patent: Oct. 30, 2012

(54) APPARATUS AND METHOD FOR MOUNTING A CLOSE-COUPLED CATALYST

(75) Inventors: Paul Matthew Biedler, Columbus, IN (US); Robert Clinton Ahrmann, Westport, IN (US)

(73) Assignee: Cummins Inc., Indianapolis, IN (US)

( * ) Notice: Subject to any disclaimer, the term of this patent is extended or adjusted under 35 U.S.C. 154(b) by 865 days.

(21) Appl. No.: 12/244,599

(22) Filed: Oct. 2, 2008

(65) Prior Publication Data

US 2010/0083644 A1 Apr. 8, 2010

(51) Int. Cl.
*F01N 3/10* (2006.01)
*F01N 1/00* (2006.01)

(52) U.S. Cl. ..... 60/302; 60/299; 60/322

(58) Field of Classification Search ..... 60/273, 60/274, 299, 302, 303, 322; 422/136, 237
See application file for complete search history.

(56) References Cited

U.S. PATENT DOCUMENTS

| | | | | |
|---|---|---|---|---|
| 5,438,828 | A * | 8/1995 | Fukae | 60/302 |
| 2005/0223698 | A1* | 10/2005 | Murata et al. | 60/286 |
| 2006/0017206 | A1* | 1/2006 | Steenackers | 267/148 |
| 2008/0246247 | A1* | 10/2008 | Hoshi | 280/280 |

FOREIGN PATENT DOCUMENTS

| | | | |
|---|---|---|---|
| DE | 102004023585 | A1 * | 12/2005 |
| JP | 63057311 | A * | 3/1988 |
| JP | 2000297638 | A * | 10/2000 |

OTHER PUBLICATIONS

Katano, English abstract of JP 2000-297638 A, Oct. 24, 2000.*
Essinger et al., English abstract of DE 102004023585 A1, Dec. 8, 2005.*
Essinger et al., machine translation of DE 102004023585 A1, Dec. 8, 2005.*
Iwasa et al., English Abstract of JP 63-057311 A, Mar. 12, 1988.*

* cited by examiner

*Primary Examiner* — Thomas Denion
*Assistant Examiner* — Audrey K Bradley
(74) *Attorney, Agent, or Firm* — Kunzler Law Group, PC

(57) ABSTRACT

Mounting close-coupled catalysts for internal combustion engines. In one aspect, supporting a catalyst in an internal combustion engine includes a mounting bracket coupled to a base surface of an engine block. One or more support rods are coupled between the mounting bracket and a housing of the catalyst, such that the catalyst is coupled to and supported by the base surface of the engine block.

17 Claims, 8 Drawing Sheets

APPARATUS AND METHOD FOR MOUNTING A CLOSE-COUPLED CATALYST

FIELD OF THE INVENTION

The present invention relates to internal combustion engines, and more particularly to mounting a catalyst for use in exhaust flow from internal combustion engines.

BACKGROUND OF THE INVENTION

Catalysts are used in internal combustion engines for emissions control of toxins and/or regulated emissions from the exhaust stream of the engine. For example, a catalyst used in a catalytic converter is commonly used in motor vehicle exhaust systems and other engine systems. The catalyst reduces the activation energy required for chemical reactions wherein combustion by-products are converted to less-toxic or non-regulated substances. Typically, the catalyst is connected to an exhaust flow of the engine to perform the desired conversion before emitting the exhaust from the engine to the atmosphere.

A close-coupled catalyst (CCC) can be used in some engines for emissions control. The close coupled catalyst is used to convert carbon monoxide (CO) and hydrocarbons (HC) to carbon dioxide and water vapor. The oxidation of these hydrocarbons is an exothermic reaction, which if harnessed, can also provide the energy required to reduce soot and particulate matter (PM) to ash. In some of these applications, a doser of the exhaust system of the engine can be located upstream in the exhaust flow and "closely coupled" to the inlet of the catalyst. The doser can introduce diesel fuel into the exhaust in a controlled manner which is then oxidized by the close coupled catalyst, generating enough heat to burn soot trapped in a downstream particulate filter. Coupling the catalyst closer to the doser gives greater oxidation time for the HC, increasing the effectiveness of the conversion process. However, coupling the catalyst too close to the doser can prevent the fuel from being sufficiently mixed in the exhaust stream, also reducing effectiveness.

While the addition of a close coupled catalyst provides a solution to certain emissions requirements, the appending of additional components to the engine creates its own set of problems. Some engine configurations are not well configured for alternate placement and support of a close-coupled catalyst. For example, hanging a catalyst element from the doser without any support loads too much weight at one end of the doser. However, there is often little room to place a support for the catalyst. In addition, placement of the catalyst may be in different locations depending on the application of the engine, especially in the plethora of vehicle chassis which each have different available space, clearance, and mounting requirements. Furthermore, overly constraining the catalyst to the block and/or other engine components may lead to failure of the system, such as cracking of component parts and gas leakage, due to thermal expansion of parts, vibration of the engine, installation preload, and/or other root causes and/or other behavioral characteristics.

Accordingly, a system and method for providing a stable and versatile mounting of a close-coupled catalyst for an engine would be desirable in many applications.

SUMMARY OF THE INVENTION

The invention of the present application relates to mounting close-coupled catalysts for internal combustion engines. In one aspect of the invention, an apparatus for supporting a catalyst in an internal combustion engine includes a mounting bracket coupled to a base surface of an engine block of the engine. One or more support rods are coupled between the mounting bracket and a housing of the catalyst, such that the catalyst is coupled to and supported by the base surface of the engine block. A similar aspect is provided for a method for implementing similar features.

In another aspect, an engine exhaust system includes a doser coupled to an exhaust system of an engine and injecting fuel into an exhaust stream received from the engine, and a catalyst coupled to the doser and receiving the exhaust stream from the doser. A support assembly supports the catalyst and includes a mounting bracket coupled to a base surface of an engine block of the engine, and one or more support rods coupled between the mounting bracket and a housing of the catalyst, such that the catalyst is coupled to and supported by the base surface of the engine block.

The present invention provides an apparatus and method for mounting a closed coupled catalyst, allowing stable support, flexibility of connection placement, and dampening of vibrations.

DETAILED DESCRIPTION

The present invention relates to internal combustion engines, and more particularly to mounting a catalyst for use in exhaust flow from internal combustion engines. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

The present invention is mainly described in terms of particular components provided in particular implementations. However, one of ordinary skill in the art will readily recognize that this apparatus will operate effectively in other implementations and applications. For example, the systems usable with the present invention can take a number of different forms.

To more particularly describe the features of the present invention, please refer to FIGS. 1-5 in conjunction with the discussion below.

Figure 1A:
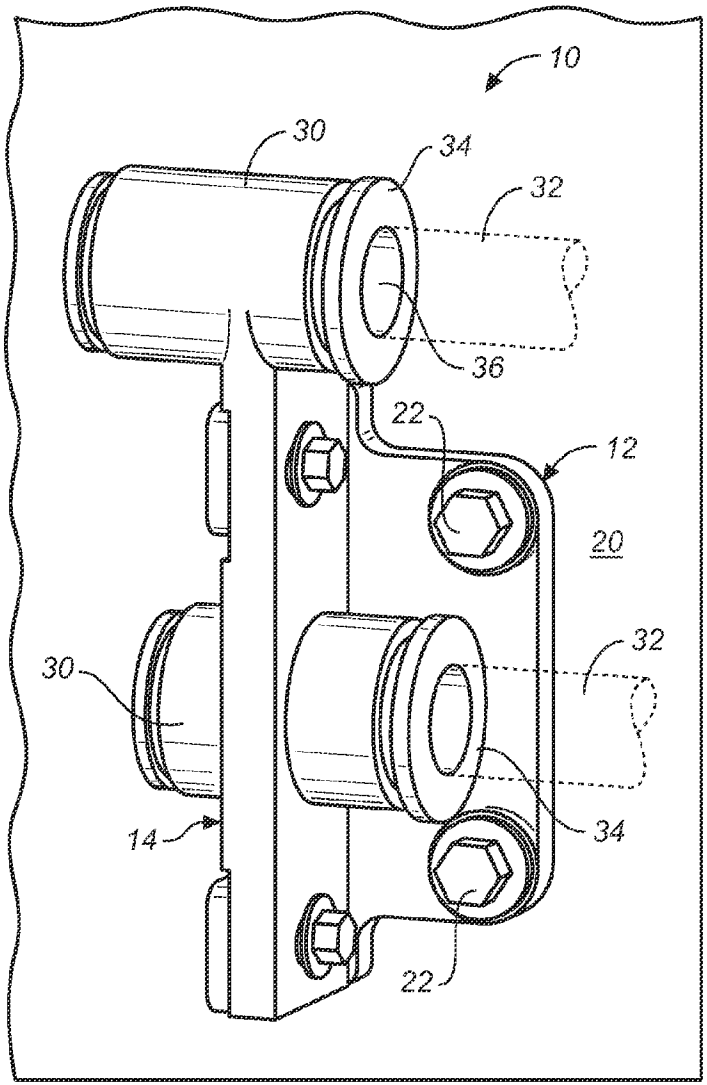
FIGS. 1A and 1B are views of a first embodiment of a close coupled catalyst support assembly of the present invention.
Figure 1B:
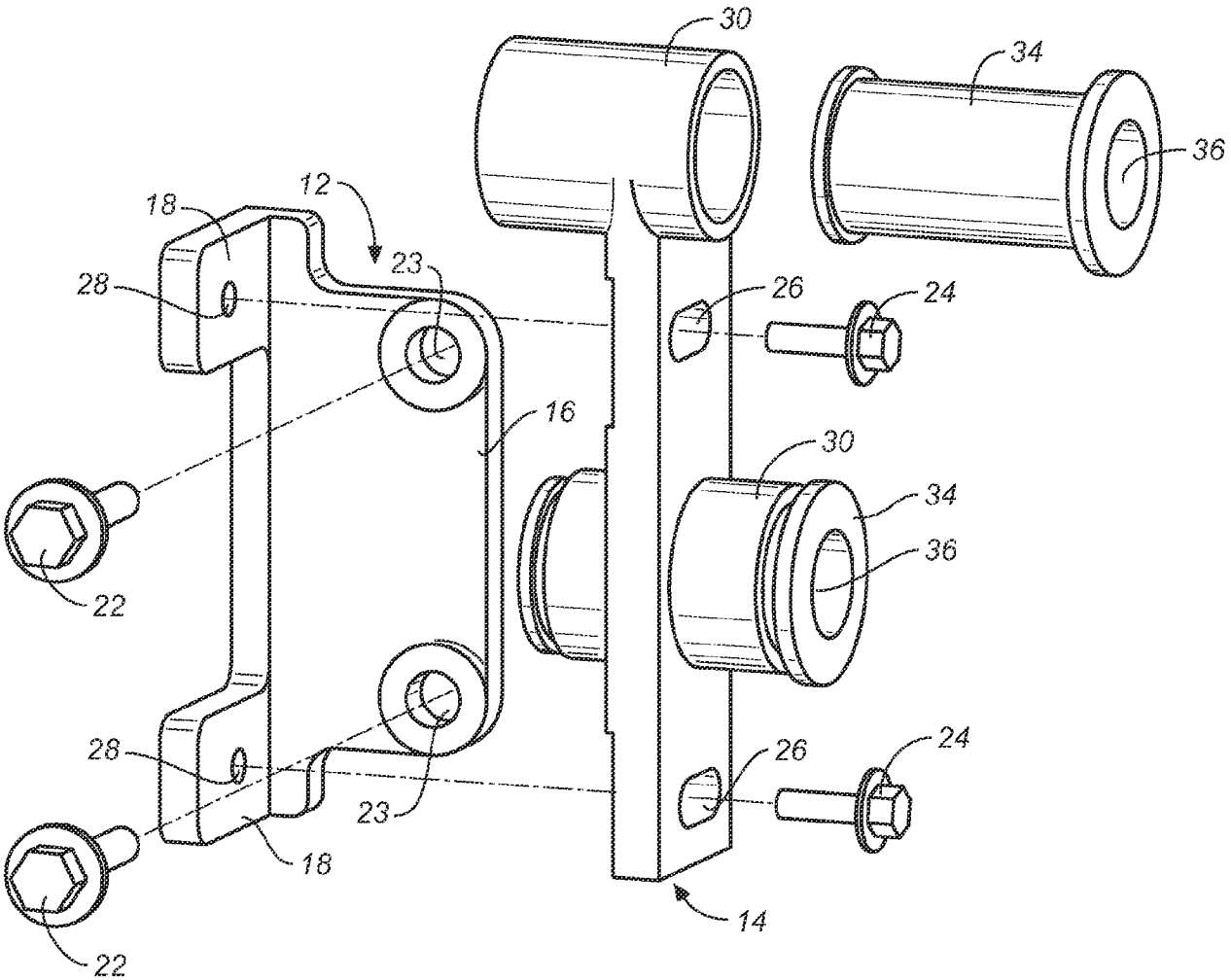

FIG. 1A is a perspective view and FIG. 1B is an exploded view a first embodiment of a close-coupled catalyst support assembly of the present invention. Support assembly includes a mounting bracket 10 and support rods 32, which are used to securely mount the catalyst to a stable engine component, such as an engine block.

Mounting bracket 10 includes a first support 12 and a second support 14. Supports 12 and 14 can be made of steel, aluminum, or other rigid material. First support 12 is an angled piece having a first extension 16 coupled to a base surface 20 of the engine, vehicle, or other mechanism, such as an engine block in an engine. A second extension 18 of the first support 12 is coupled to the second support 14 and extends at about a 90-degree angle, for example, relative to the first extension. In the described embodiment, the second extension 18 includes two different legs, each leg having a threaded hole 28. The first support 12 is attached to the base surface 20 with one or more appropriate fasteners, such as screws, adhesives, or other type. In the embodiment of FIGS. 1A and 1B, screws 22 extend through holes 23 in the first extension 16 and are secured in threaded holes of the base surface 16.

The second support 14 is attached to the first support 12 via appropriate fasteners. For example, in the described embodiment, screws 24 extend through elongated holes 26 in the second support 14 and engage with the threaded holes 28 in the second extension 18 of the first support 12. Preferably, the holes 26 in second support 14 are elongated as shown (e.g., a slot with rounded ends), or are otherwise oversized, so as to allow the second support 14 some tolerance and adjustment of position relative to the first support 12 when assembling the bracket 10 and other components connected thereto. This permits greater ease in assembling the supports 12 and 14 and allows for tolerances in manufacture and variations in size and/or location of the other components of the engine. For example, the tolerance allowed by the elongated holes 26 can add to the total amount of misalignment calculated to be allowed when bolting all the components together.

Second support 14 includes one or more receptacles 30, where each receptacle is used to seat or receive and secure the end of a corresponding support rod 32 (shown in dashed lines in FIG. 1A). Two receptacles 30 and two corresponding support rods 32 are shown in the embodiment of FIGS. 1A-1B, but other embodiments may include less or more receptacles and support rods. The support rods 32 are used to support the catalyst, as described in greater detail below with respect to FIGS. 3 and 4. The described embodiment provides receptacles at about 90 degrees to the extension direction of second extension 18. The receptacles 30 can have length(s) suitable for securing a support rod and fitting into available space near the engine.

Furthermore, in the described embodiment, grommets 34 are provided in the receptacles 30. The grommets 34 can be made of an elastomeric material, such as rubber, silicon, plastic, Viton™ products, or other resilient or elastic material. Each grommet 34 includes a central aperture 36 into which the end of a support rod 32 is inserted. The grommets provide dampening to motion or vibration between the catalyst and the engine block, such that vibration of the catalyst, for example, does not cause excessive vibration of the support rods. In some embodiments, overmolding of the grommets 34 on the bracket second support 13 can be provided, such that the grommets 34 are attached to the bracket (e.g. attached by injection) by a manufacturer. This can, for example, reduce the number of installation and assembly steps of the catalyst support assembly.

The bracket 10 also can allow alternate configurations. For example, the second support 14 can be flipped over from the position shown in FIGS. 1A-1B and then attached to the first support 12 to provide the receptacles 30 in a different configuration that may be more suitable for the available space and component layout in particular embodiments.

Figure 2:
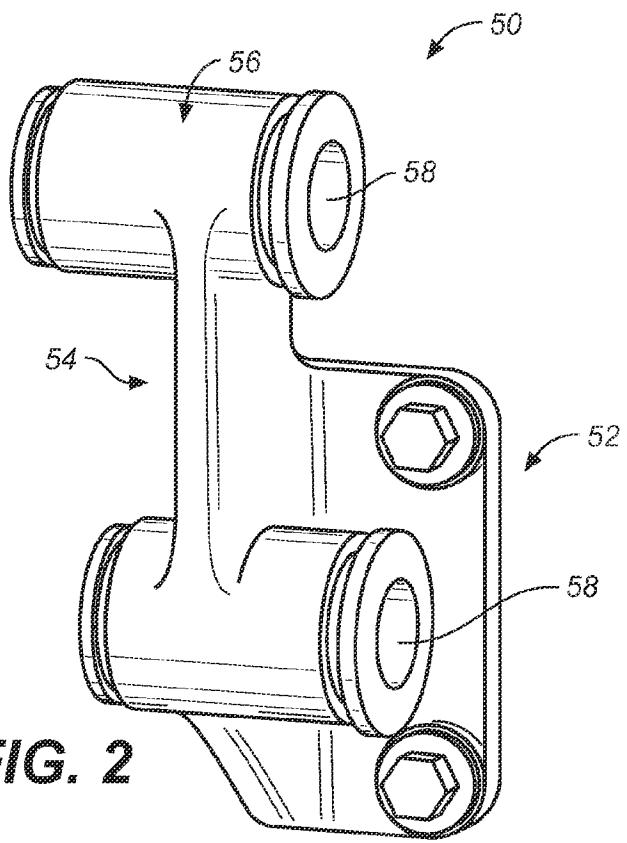
FIG. 2 is a perspective view of an alternate embodiment of a close coupled catalyst mounting bracket of the present invention.

FIG. 2 is a perspective view of an alternate embodiment 50 of a close-coupled catalyst mounting bracket of the present invention. Bracket 50 is not formed from two separate supports such as first support 12 and second support 14 of the bracket 10 of FIGS. 1A and 1B, but is formed as a unitary piece. Thus, an extension 52 is attached to a base surface similarly to the first extension 14 of bracket 10, and an extension 54 is coupled to the extension 52 and extends about 90 degrees relative to the extension 52. The extension 54 can include receptacles 56 and rubber grommets 58 to receive support rods 32, similar to the corresponding features of bracket 10 of FIGS. 1A and 1B.

Figure 3A:
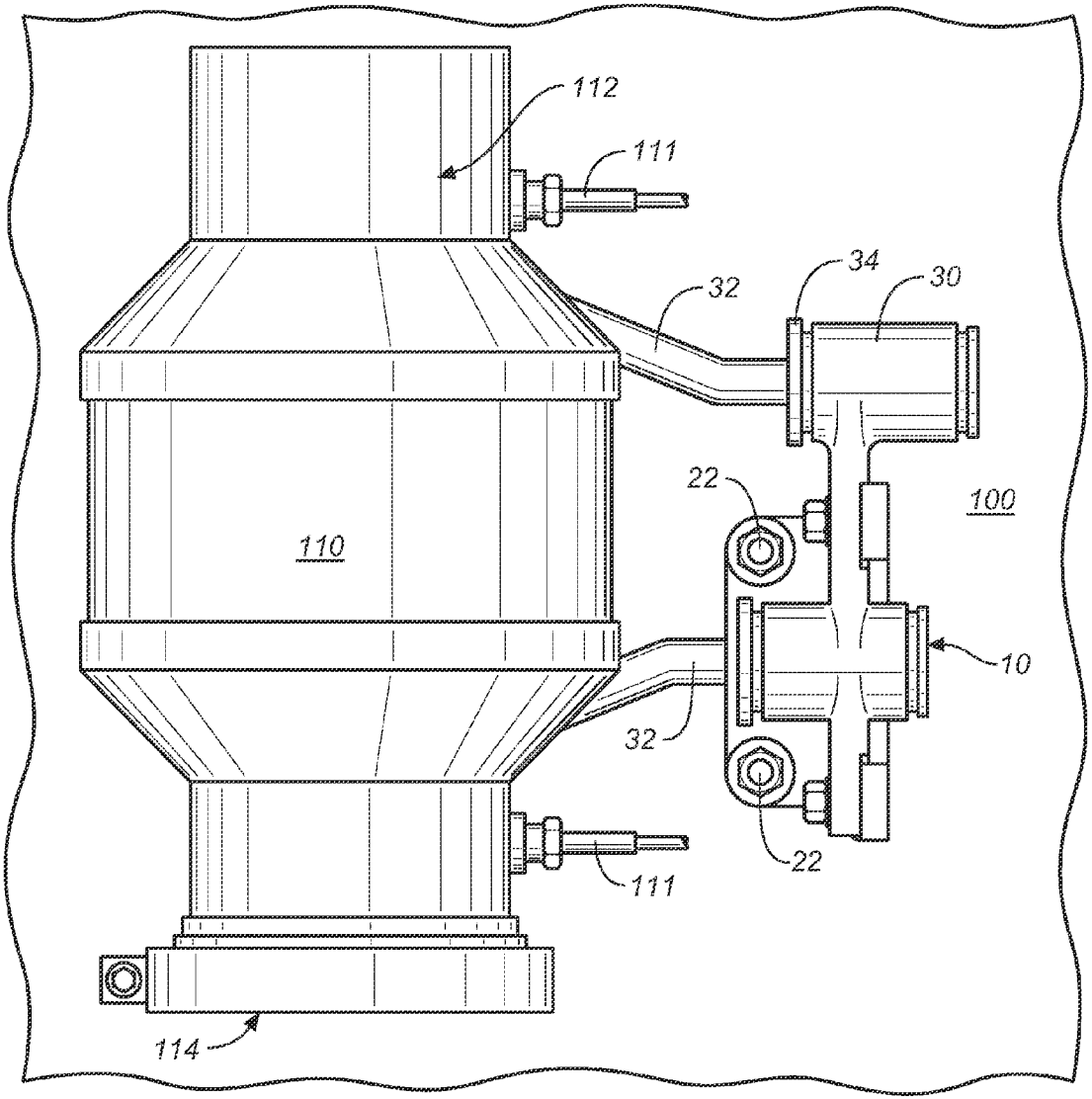
FIGS. 3A and 3B are views of the close coupled catalyst support assembly of FIGS. 1A and 1B, connected to a catalyst and to a power engine block of an internal combustion engine in a first configuration.
Figure 3B:
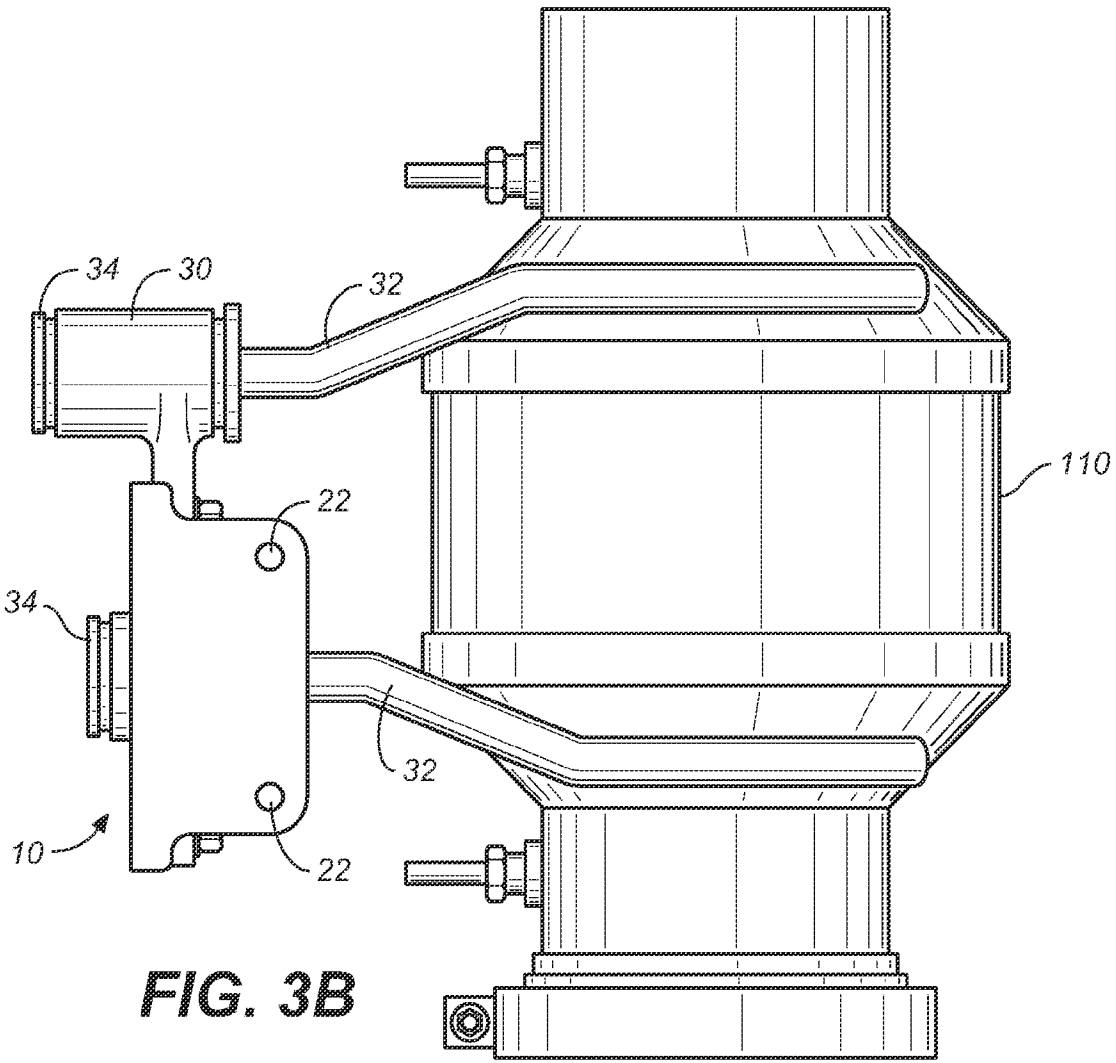

FIG. 3A is a perspective view of one side and FIG. 3B is a side elevational view of the opposite side of the close-coupled catalyst support assembly of FIGS. 1A and 1B, connected to a catalyst and to a power engine block of an internal combustion engine in a first configuration. The internal combustion engine can be used in a variety of applications, including automotive, off highway, power generation and marine applications, and can be a diesel engine or other type of engine. A catalyst element 110 can be provided as part of an exhaust system connected to the engine, where the element 110 is supported by the mounting bracket 10 and includes the catalyst. The orientation of the catalyst element 110 in the embodiment of FIGS. 3A and 3B allows the exhaust flow through the catalyst element 110 in an approximately "down" direction, i.e., substantially parallel to the direction of gravity. The components may be oriented in other directions, such as one example described below with reference to FIGS. 4A-4C.

Mounting bracket 10 is coupled to an engine block 100 by screws 22. A support rod 32 is inserted in each of the rubber grommets 34 within the receptacles 30 of the bracket 10. The support rods 32 can be made of stainless steel or other rigid material suitable for support.

Catalyst element 110 is coupled to the support rods 32. For example, the support rods 32 can be welded to the outer housing of the catalyst element 110 as shown in FIG. 3B so as to cradle the catalyst element 110. The catalyst element 110 can be, for example, a particulate filter system such as a flow-through oxidation catalytic converter, and is coupled to the engine by an inlet 112 which receives an exhaust stream from the engine 100. In the described embodiment, the inlet 112 is coupled upstream (i.e., "closely coupled") to a doser (not shown) that can be in turn coupled upstream to a turbocharger (not shown), which can be connected to an exhaust manifold (not shown) that is connected to the exhaust ports of the engine 100. In one example embodiment, an engine used with the present invention can include a number of exhaust ports, such as six, as well as an exhaust manifold and then the turbocharger, which are all part of the exhaust system of the engine. In such an embodiment the doser can be connected to the turbocharger.

Other configurations and components can be provided in other embodiments. For example, some configurations may provide the doser upstream of the turbocharger, such that the inlet 112 is coupled upstream to the turbocharger instead of the doser. The doser can be used to introduce a dosing agent into the exhaust stream, such as diesel fuel or other type of fuel from a connected fuel line, where the dosing agent (e.g. diesel fuel) provides a source of hydrocarbons, which when converted by the CCC provides the energy required to burn soot and particulate matter. In other embodiments, the catalyst element 110 can be coupled to other components in an engine exhaust management system or other subsystem.

For example, the catalyst element 110 can include a diesel oxidation catalyst which uses a chemical process to break down pollutants in the exhaust stream into less harmful components. For example, the catalyst can include a porous ceramic honeycomb-like structure that is coated with a material (such as a catalytic precious metal) that catalyzes a chemical reaction with the exhaust stream to reduce pollution in the stream. Two thermistor plugs 111 can be provided at either end of the catalyst housing, as shown, for temperature measurement. Other types of catalysts can be used in other embodiments.

The outlet 114 of the catalyst element 110 can be coupled to additional exhaust components, not shown. For example, the exhaust stream from engine 12 can pass through the catalyst element 110 to a soot filter which filters soot emissions in the exhaust which are not affected by the catalyst element 110. The exhaust stream is eventually released via an outlet to the exterior environment, such as the atmosphere.

The support rods 32 provide a support connection for the catalyst element 110 to a stable surface or component, such as the engine block 100, via the bracket 10. This support provides stability to the catalyst element 110, which would otherwise only be supported by the end of the doser, and place too much weight on the doser. The support rods 32 allow more flexibility in the location of the mounting bracket 10, which is an important consideration due to the typically constrained space available in engines. Furthermore, the grommets 34 of the mounting bracket 10 cushion the support rods 32 and thus reduce vibration to the catalyst element 110 from the engine block 100. If the catalyst were hard-mounted to the engine block without grommets 34, vibration from the engine and/or vehicle, plus thermal expansion, may cause components to crack.

Figure 4A:
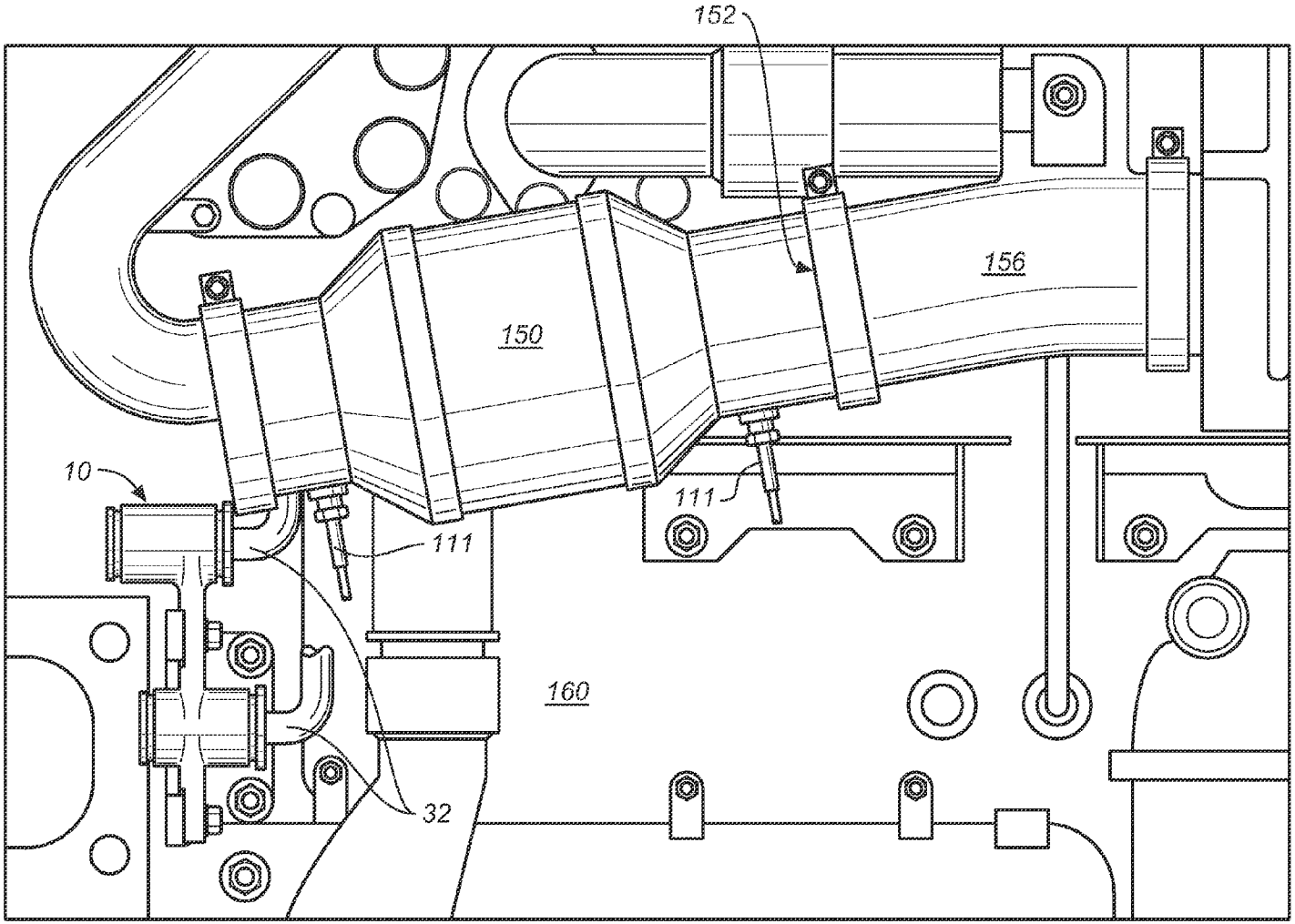
FIGS. 4A, 4B and 4C are views of the close coupled catalyst support assembly of FIGS. 1A and 1B, connected to a catalyst and to a power engine block of an internal combustion engine in a second configuration.
Figure 4B:
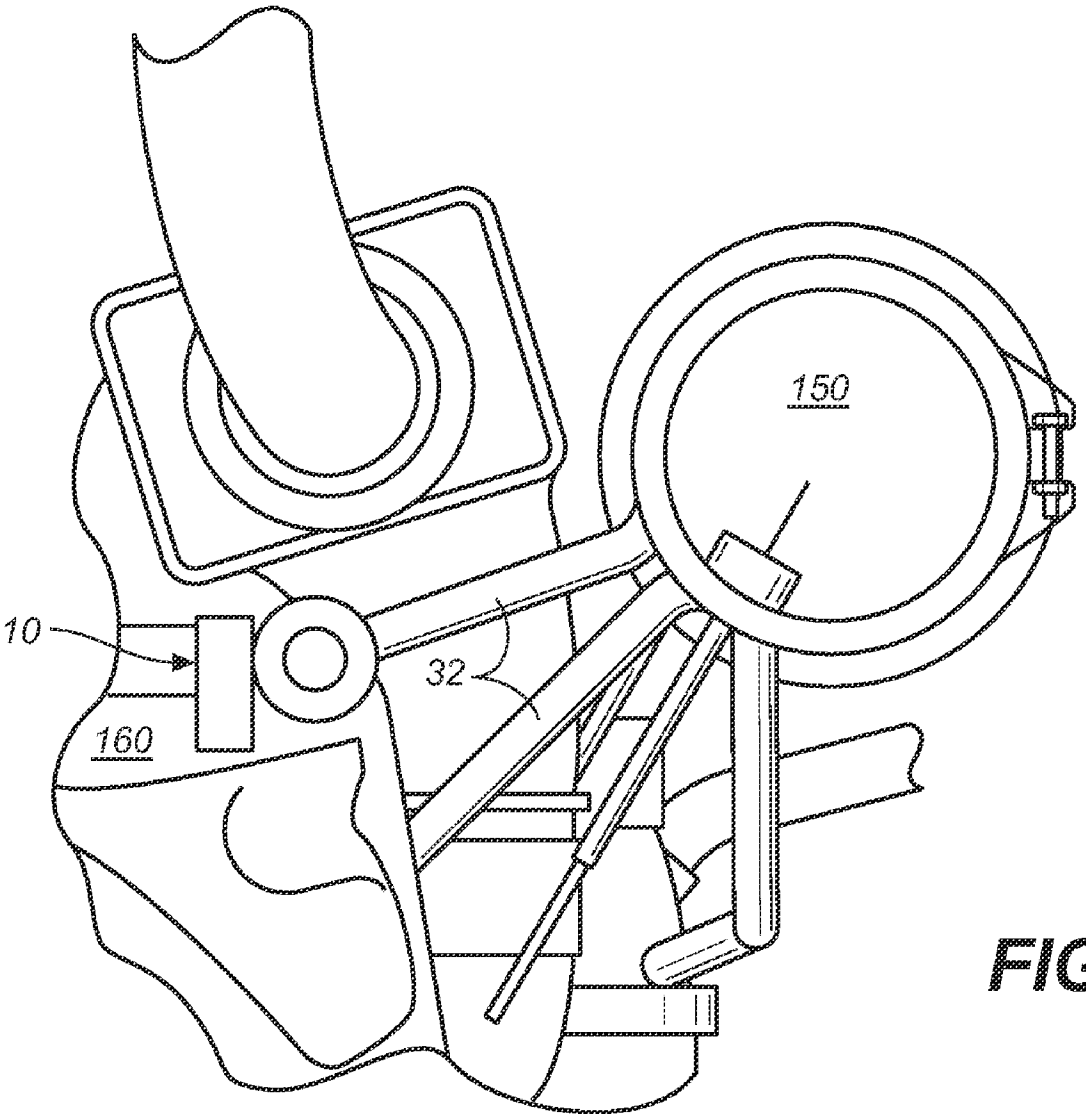
Figure 4C:
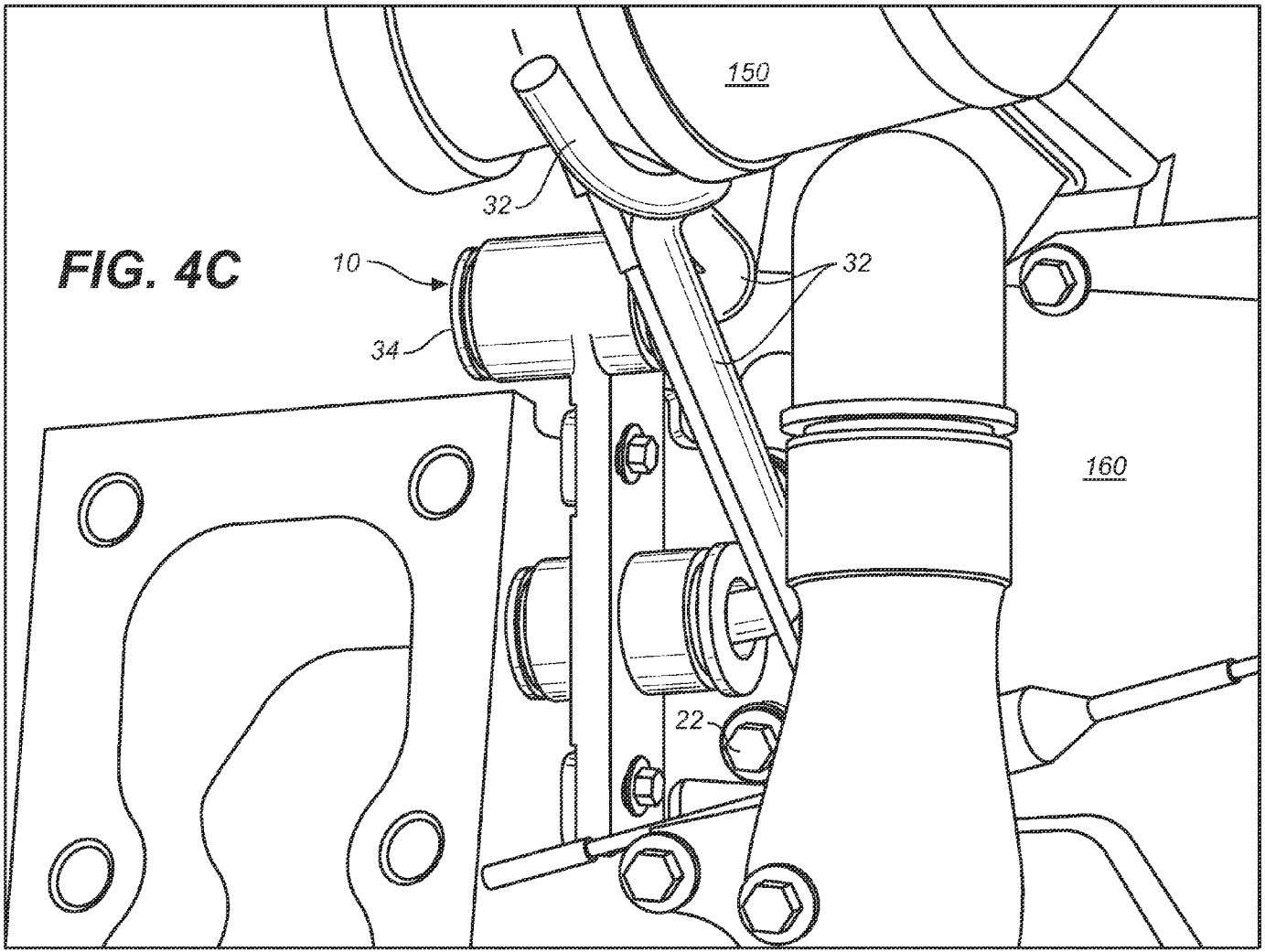

FIGS. 4A, 4B, and 4C are perspective views of a second configuration of the close-coupled catalyst support assembly of FIGS. 1A and 1B, connected to a catalyst and to a power engine block of an internal combustion engine. As shown in FIG. 4A, the inlet 152 of catalyst element 150 is coupled to doser 156, and the outlet 154 of the catalyst element 150 can be coupled to additional exhaust components (not shown), similarly as explained above with reference to FIGS. 3A and 3B.

The orientation of the catalyst element 150 in the embodiment of FIGS. 4A-4C allows the exhaust flow through the catalyst element 110 in an approximately "back" direction, i.e., substantially perpendicular to the direction of gravity and towards the back of a vehicle in which the engine is located. The components may be oriented in other directions in other embodiments.

The mounting bracket 10 is coupled to an engine block 160 at a different orientation and location relative to the catalyst element 150 as compared to the orientation and location shown in FIGS. 3A and 3B. In the embodiment of FIG. 4A, there are greater space limitations on the engine block 160 than on engine block 100 of FIG. 3A, and the engine block 160 does not allow as many locations for the mounting bracket 10. For example, there may be an EGR (exhaust gas recirculation) cooler next to the catalyst 150, which has a thin metal shell and thus cannot be a base surface for mounting the bracket 10. Similarly, the mounting bracket 10 would typically not be mounted to an exhaust manifold, due to the extra weight put on the manifold and greater chance for cracking of the manifold. Thus support rods 32 are used to position the bracket 10 at an available appropriate location on the engine block.

The support rods 32 extend from the bracket 10 to the housing of the catalyst element 150, to which they are welded. The rods 32 can be bent toward the housing of the catalyst element 150 from the bracket 10, as appropriate to the component layout of a particular embodiment and engine. As shown in FIG. 4B, the rods 32 can be welded on different sides of the housing so as to center the weight of the catalyst element 150 between the two rods 32. The support rods 32 transfer the weight of supporting the catalyst element 150 over a distance from the catalyst element, so that an available location on the engine block can be used as a support. Thus the support rods 32 allow a variety of locations and orientations of the mounting bracket 10, permitting significant flexibility for engine assembly. This configuration offers greater stability and flexibility than, for example, a single heavy cast support piece.

Figure 5:
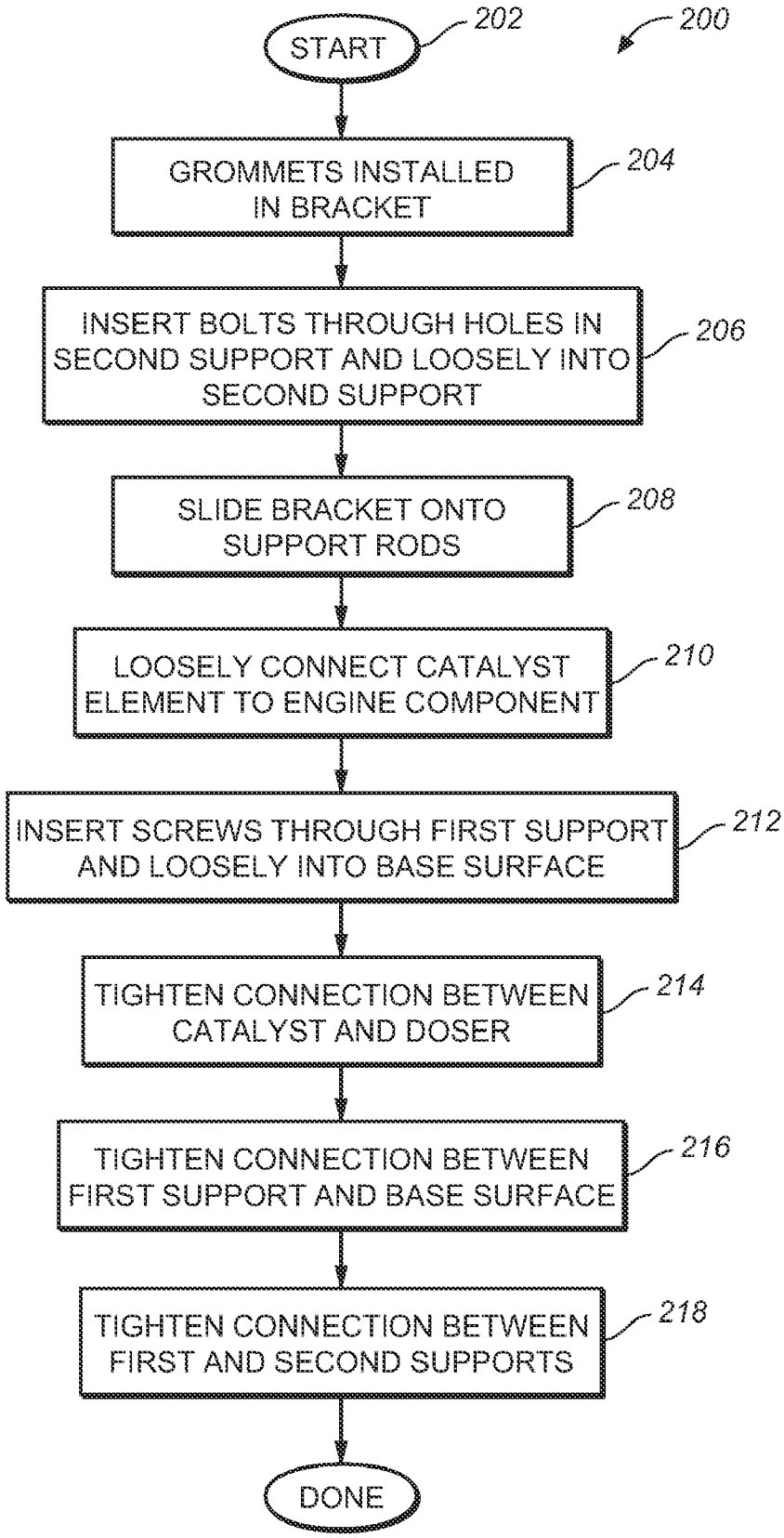
FIG. 5 is a flow diagram illustrating an example method for assembling the support assembly of FIGS. 1A-1B and a catalyst.

FIG. 5 is a flow diagram illustrating one example of a method 200 of assembling the support assembly of FIGS. 1A-1B and catalyst. The method starts at 202, and in step 204, the grommets 34 have previously been installed in the receptacles 30, or are presently installed, and the support rods 32 have previously been attached to the catalyst element 110 or 150. In next step 206, the bolts 24 are inserted through the oversized holes 26 in the second support 14 and loosely inserted in the threaded holes 28 of the first support 14. In next step 208, the bracket 10 is slid onto the support rods 32 which previously have been coupled to and extend from the catalyst element 110 or 150 (which is unconnected). In next step 210, the catalyst element 110 or 150 is loosely connected to the appropriate engine component, such as doser 156. In next step 212, the screws 22 are loosely inserted through the holes 23 of the first support 12 and into threaded holes of the base surface, such as the engine block 100 or 160. In next step 214, the connection between catalyst element 110 or 150 and doser 156 (or other engine component) is tightened, then in step 216 the screws 22 to the base surface are tightened, and finally in step 218 the bolts 24 between first and second supports are tightened. The tolerance allowed by the oversized apertures 26 in the second support 14 of the bracket 10 allows the screws 24 to be tightened last, after they may have moved to adjust to the tightening of the other connections.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. An apparatus for supporting a catalyst in an internal combustion engine, the apparatus comprising:

a mounting bracket comprising a first plate coupled to a base surface of an engine block of the engine, the mounting bracket further comprising a second plate coupled to and extending substantially transversely away from the first plate;

at least one receptacle coupled to the second plate, the at least one receptacle comprising an elongate cylindrically-shaped tube, the at least one receptacle having a length greater than a thickness of the second plate, wherein the at least one receptacle extends lengthwise in a direction substantially parallel to the first plate;

at least one elastomeric material positioned within the elongate cylindrically-shaped tube of the at least one receptacle, the elastomeric material having a length at least as long as the length of the at least one receptacle, the elastomeric material defining an elongate channel extending the length of the elastomeric material; and at least one support rod coupled between the mounting bracket and a housing of the catalyst, such that the catalyst is coupled to and supported by the base surface of the engine block, the at least one support rod comprising a first end portion seated within the elongate channel of the elastomeric material and a second end portion attached to the housing;

wherein the at least one support rod is curved to allow desired placement of the mounting bracket with respect to the engine block.

2. The apparatus of claim 1 wherein the second plate includes at least one oversized hole, such that a fastener can be inserted through the oversized hole and fastened to the first plate, and wherein the at least one oversized hole allows movement of the first plate relative to the second plate for tolerance fitting of the mounting bracket.

3. The apparatus of claim 1 wherein an inlet of the catalyst is coupled to an outlet of a doser or a turbocharger.

4. The apparatus of claim 1 wherein the at least one elastomeric material is provided by overmolding the elastomeric material on the mounting bracket.

5. The apparatus of claim 1 wherein the at least one receptacle extends lengthwise in a direction substantially transversely relative to the second plate.

6. The apparatus of claim 2 wherein the at least one elastomeric material is in the form of one or more grommets.

7. The apparatus of claim 3 wherein the at least one receptacle comprises a plurality of receptacles, the at least one elastomeric material comprises a plurality of elastomeric materials, and the at least one support rod comprises a plurality of support rods, wherein each receptacle seats one of the elastomeric materials, and wherein each elastomeric material receives a respective one of the support rods.

8. A method for supporting a catalyst in an internal combustion engine, the method comprising:

providing a mounting bracket comprising a first plate and a second plate coupled to and extending substantially transversely away from the first plate, the mounting bracket further comprising at least one receptacle coupled to the second plate at a location away from the first plate, wherein the at least one receptacle defines a channel extending in a direction substantially parallel to the first plate;

securing the first plate to a base surface of an engine block of the internal combustion engine such that the at least one receptacle is positioned away from the base surface; and inserting a first end portion of a support rod into the channel of the at least one receptacle such that the first end portion is substantially parallel to the first plate, wherein a second end portion is secured to a housing of the catalyst, and wherein the support rod is bent such that a portion of the support rod between the first and second end portions extends at an angle relative to the first end portion.

9. The method of claim 8 wherein the support rod is bent to allow desired placement of the mounting bracket with respect to the engine block.

10. The method of claim 8 further comprising coupling an inlet of the catalyst to an outlet of a doser or an outlet of a turbocharger.

11. The method of claim 8 wherein a fastener is inserted through an oversized hole in the second plate and fastened to the first plate, and wherein the at least one oversized hole allows movement of the first plate relative to the second plate for tolerance fitting of the mounting bracket.

12. The method of claim 11 further comprising tightening a connection of the catalyst to an engine component and tightening a connection of the mounting bracket to the base surface before tightening a connection of the first plate to the second plate.

13. The method of claim 8 wherein an elastomeric material is provided in the mounting bracket, the elastomeric material seating the first end portion of the support rod and providing isolation to the catalyst from vibration of the engine block.

14. The method of claim 13 wherein the elastomeric material is in the form of one or more grommets, each grommet corresponding to one of the at least one support rod and coupled to the first end portion of the corresponding support rod.

15. The method of claim 14 wherein the at least one receptacle seats one of the one or more grommets.

16. An engine exhaust system coupled to a vehicle having an internal combustion engine, comprising:

a first exhaust aftertreatment component housing communicable in exhaust receiving communication with the internal combustion engine;

a second exhaust aftertreatment component housing communicable in exhaust receiving communication with the first exhaust aftertreatment component housing, an inlet of the second exhaust aftertreatment component housing being coupled to the first exhaust aftertreatment component housing and supported relative to the vehicle by the first exhaust aftertreatment component housing;

a third exhaust aftertreatment component housing communicable in exhaust receiving communication with the second exhaust aftertreatment component housing, an outlet of the second aftertreatment component housing being coupled to the third exhaust aftertreatment component housing and supported relative to the vehicle by the third exhaust aftertreatment component housing; and a support assembly further supporting the second exhaust aftertreatment component housing relative to the vehicle, the support assembly comprising:

a mounting bracket comprising a first support coupled directly to a base surface of the vehicle, and a second support extending away from the first support and base surface of the vehicle;

at least one receptacle coupled to the second support at a location away from the first support and base surface of the vehicle;

an elastomeric material positioned within the at least one receptacle; and at least one support rod comprising a first end portion coupled to the second exhaust aftertreatment component housing and a second end portion positioned within the elastomeric material and the at least one receptacle, wherein the at least one support rod is curved to allow desired placement of the mounting bracket with respect to the engine block.

17. The engine exhaust system of claim 16 wherein the elastomeric material is configured to seat the second end portion of the at least one support rod and provide isolation to the catalyst from vibration of the vehicle, wherein the elastomeric material is in the form of one or more grommets, each grommet corresponding to one of the at least one support rod.

* * * * *